US009526331B2

(12) United States Patent
Vazquez

(10) Patent No.: US 9,526,331 B2
(45) Date of Patent: Dec. 27, 2016

(54) MODULAR FURNITURE SYSTEM AND MODULAR FURNITURE

(71) Applicant: Eduardo De Leon Vazquez, Miguel Hidalgo (MX)

(72) Inventor: Eduardo De Leon Vazquez, Miguel Hidalgo (MX)

( * ) Notice: Subject to any disclaimer, the term of this patent is extended or adjusted under 35 U.S.C. 154(b) by 244 days.

(21) Appl. No.: 14/134,556

(22) Filed: Dec. 19, 2013

(65) Prior Publication Data

US 2015/0083683 A1 Mar. 26, 2015

(30) Foreign Application Priority Data

Sep. 26, 2013 (MX) ..... MX/a/2013/011128

(51) Int. Cl.
*A47B 47/00* (2006.01)
*A47B 96/14* (2006.01)

(52) U.S. Cl.
CPC ..... *A47B 47/0091* (2013.01); *A47B 47/0008* (2013.01); *A47B 47/0016* (2013.01); *A47B 47/0041* (2013.01); *A47B 96/14* (2013.01); *A47B 96/1408* (2013.01)

(58) Field of Classification Search
CPC ..... A47B 47/0041; A47B 47/0042; A47B 47/0008; A47B 47/0016; A47B 47/0025; A47B 47/0033; A47B 47/05; A47B 47/0091; A47B 96/14; A47B 96/1408; A63H 33/10; A63H 33/107; A63H 33/108; A63H 33/12; A63H 33/044; A63H 33/105
USPC ..... 446/122, 123; 108/60; 312/107, 111
See application file for complete search history.

(56) References Cited

U.S. PATENT DOCUMENTS 1,701,190 A 2/1929 Paulson
2,967,747 A * 1/1961 Bus ..... F16B 12/2036 312/265.5
3,229,334 A * 1/1966 Thome ..... A47B 47/0025 403/173
3,234,896 A * 2/1966 Bonsall ..... A47B 87/0246 108/60
3,685,465 A * 8/1972 Haumer ..... A47B 47/0041 108/60
4,009,665 A * 3/1977 Weisheit ..... A47B 47/0025 108/157.13
4,547,160 A * 10/1985 Labelle ..... G09B 1/40 273/292
4,691,644 A 9/1987 Frydman
(Continued)

FOREIGN PATENT DOCUMENTS

AU 10021 83 A 7/1983
CA 929199 6/1973
(Continued)

OTHER PUBLICATIONS

Extended European Search Report—Application No. 13198638.2 dated Mar. 3, 2015.

*Primary Examiner* — Patrick Hawn
(74) *Attorney, Agent, or Firm* — Heslin Rothenberg Farley & Mesiti P.C.

(57) ABSTRACT

Modular furniture pieces and, more specifically, a system of modular furniture pieces. The modular furniture pieces system comprises a plurality of unitary blocks joined by means of at least one bar. The plurality of blocks which are conjoined and immediate to one another, joined by an equal number of bars, form a cell.

19 Claims, 9 Drawing Sheets

(56) References Cited

U.S. PATENT DOCUMENTS

| | | | | | |
|---|---|---|---|---|---|
| 4,886,326 | A * | 12/1989 | Kuzyk | A47B 47/0041 | 108/180 |
| 5,009,599 | A * | 4/1991 | Mueller | G09B 11/00 | 434/81 |
| 5,152,530 | A * | 10/1992 | Dodek, II | A63F 9/12 | 273/156 |
| 5,536,078 | A * | 7/1996 | Novikoff | A47B 21/00 | 312/111 |
| 5,810,505 | A * | 9/1998 | Henriott | F16B 12/14 | 108/153.1 |
| 6,474,759 | B2 | 11/2002 | Hsu | | |
| 6,746,297 | B2 * | 6/2004 | Robjent | A63H 33/062 | 446/108 |
| 7,431,409 | B2 * | 10/2008 | Yang | A47B 47/0041 | 312/263 |
| 7,918,515 | B2 * | 4/2011 | Wang | A47B 87/005 | 211/194 |
| 7,967,656 | B2 * | 6/2011 | Hu | A63H 33/10 | 446/123 |
| 9,060,602 | B2 * | 6/2015 | Chen | A47B 47/0016 | |
| 2004/0222722 | A1 * | 11/2004 | Yang | A47B 47/0041 | 312/265.5 |
| 2008/0200091 | A1 * | 8/2008 | Blaivas | A63H 33/12 | 446/122 |

FOREIGN PATENT DOCUMENTS

| | | | |
|---|---|---|---|
| DE | 20 2011 050438 | U1 | 9/2011 |
| WO | 03092436 | A2 | 11/2003 |
| WO | 2005013766 | A1 | 2/2005 |
| WO | 2013020721 | A1 | 2/2013 |
| WO | 2013064259 | A1 | 5/2013 |

* cited by examiner

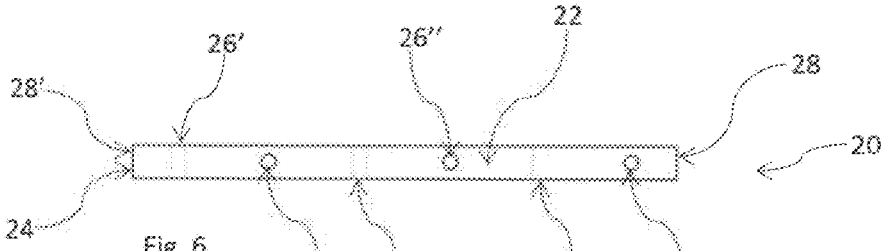
Fig. 6
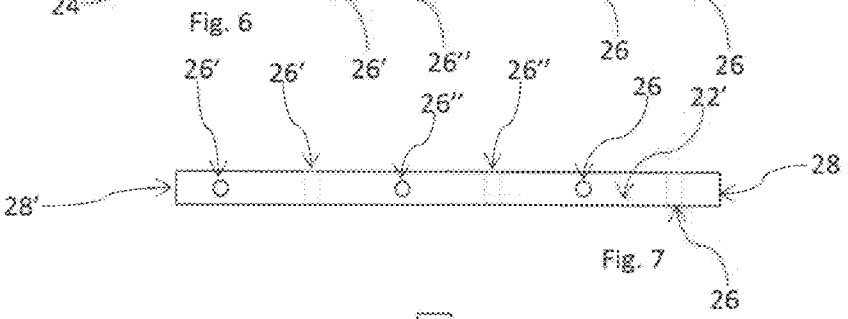
Fig. 7
Fig. 8
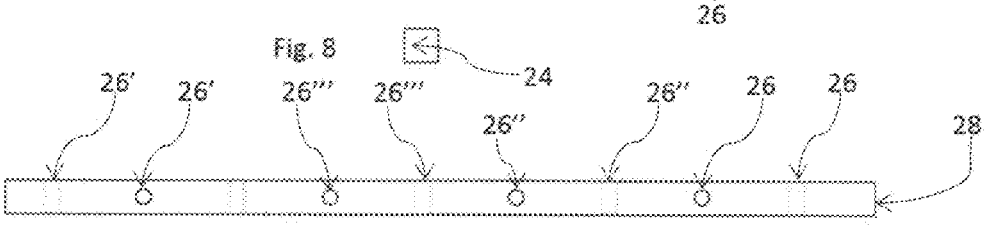
Fig. 9
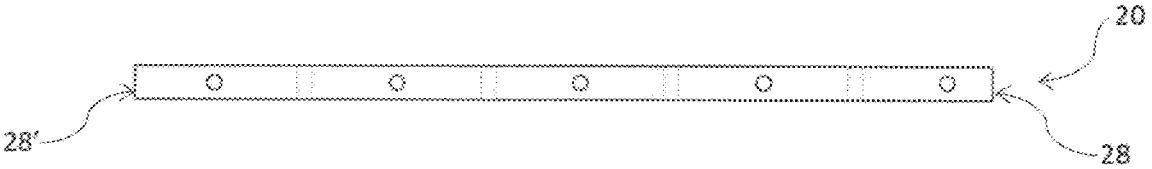
Fig. 10
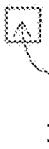
Fig. 11

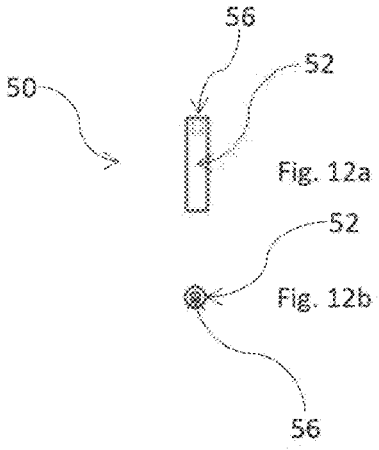
Fig. 12a
Fig. 12b
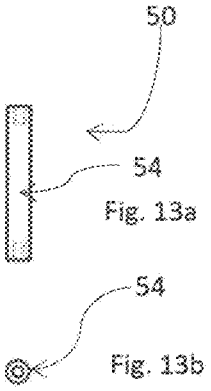
Fig. 13a
Fig. 13b
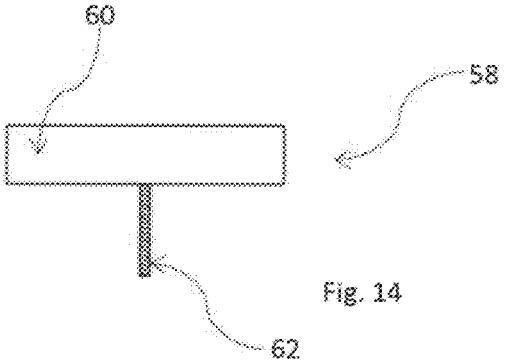
Fig. 14

MODULAR FURNITURE SYSTEM AND MODULAR FURNITURE

CROSS REFERENCE TO RELATED APPLICATIONS

This application claims priority to Mexican Patent Application No. MX/a/2013/011128 filed on Sep. 26, 2013 in the Mexican Patent Office, the entire disclosure of which is incorporated herein by reference.

FIELD OF INVENTION

The present invention refers to modular furniture pieces. Specifically, the present invention makes known a furniture system comprising a plurality of basic construction blocks. These blocks serve both as a storage space as well as a division between the work areas. The blocks form cells are adapted to be combined and set and, thus, provide a variety of furniture system arrangements which are almost limitless.

BACKGROUND

It is common that furniture consumers seek certain versatility in furniture with the end goal that said furniture pieces can be adapted to different places at different moments, granting them versatility in their use, in combination with moderate pricing and pleasant appearance.

Particularly, modular furniture pieces must be easily adaptable to disposable spaces and to the everyday needs of the consumer. At the same time, it is necessary that modular furniture may be easily changed quickly, according to the changing needs, without requiring substantial modifications and without the help of a technician. Thus, modular furniture pieces must be able to easily and quickly be assembled and disassembled.

Thus, a modular piece of furniture presents, among others, the following technical advantages over pre-manufactured or non-modular pieces of furniture:

(a) a pre-manufactured or non-modular piece of furniture cannot be moved or disassembled to be re-distributed; and (b) skilled workers are required when a pre-manufactured or non-modular piece of furniture is placed in a room.

At the same time, the known modular pieces of furniture suffer from difficulty of assembly and in certain cases, suffer equally from their weight, so that the assembly of modular pieces of furniture must be carried out by skilled workers, or in any case, unskilled people who encounter great difficulties upon assembling known structures.

Several documents disclose modular furniture, for example, Canadian patent number 929199, publications PCT Numbers WO 2005/013766, WO 03/092436, WO 2013/064259, WO 2013/020721, as well as U.S. Pat. No. 6,474,759 and U.S. Pat. No. 4,691,644.

Thus, an objective of the present invention is modular pieces of furniture which are easy to assemble, light and easy to disassemble. In addition to this objective, the objective of the modular system being able to be built by an unskilled person also exists.

SUMMARY

A modular furniture system and a modular furniture piece formed from the system comprising a block with main faces and secondary faces which have a first perforation and a second perforation, the first perforation is closer to a first corner in comparison to the second perforation to a second corner, wherein the first and second corners are opposite to each other; a bar with main faces and secondary faces, over each one of the main faces of the bar, at least one first perforation and one second perforation are found, the first perforation of the main face of the bar is closer to a first corner in comparison to the second perforation of the main face of the bar to the second corner, the first and second corners are opposite to each other, and wherein the perforations over the main faces of the bar cross through to the opposite face of the bar; a first joining means capable of being inserted into a perforation of a block and of the bar; wherein the block and the bar form a connection by means of the insertion of the first joining means; and wherein upon joining the block and the bar, the perforations of the block are coaxial to the perforations of the bar.

BRIEF DESCRIPTION OF PRESENT INVENTION

The present invention refers to modular furniture pieces and more specifically to a system of modular furniture pieces. The modular furniture pieces system comprises a plurality of unitary blocks joined by means of at least one bar. The plurality of blocks which are conjoined and immediate to one another, joined by an equal number of bars, form a cell.

Each block is preferably, a hexahedron, wherein each hexahedron has preferably flat and smooth faces. It is preferable that said block be a cuboid. The cuboid is formed by two main faces, which may be a frontal face and a back face, or an upper face and a lower face, wherein the main faces are preferably square. However, it is possible that the main faces be any other type of quadrilateral, for example rectangular. On the other hand, it is preferable that the cuboid have secondary faces, such as the four side faces and that said secondary faces be rectangular. However, a cuboid whose side faces are any other type of quadrilateral, for example squares, is possible. Each one of the four secondary faces of the block has at least two perforations, wherein a first perforation is near a first corner and distant from a second corner. A second perforation is distant from the first corner, and is also found, in proportion to the first perforation and the first corner, distant from the second corner. It is required that the perforation pattern be repeated on each one of the four secondary faces of the block.

A bar is capable of joining four different blocks, wherein the four different blocks joined by said bar, generally have an opposite direction. Specifically the bar joins blocks at 0°, 90°, 180° and 270° to each other. In turn, in order to form a cell, four bars are needed. Each bar is preferably a hexahedron, wherein said hexahedron preferably has flat and smooth faces. It is preferable that said bar be a cuboid. The bar cuboid is formed by four main faces which preferably are rectangular, and more preferably that said main faces of the bar match the shape to the secondary faces of the block. On the other hand, it is preferable that the cuboid have two secondary faces and that said secondary faces be squares. However, it is possible to have a cuboid whose side faces are any other type of quadrilateral, and where preferably said side faces have a height similar to the height and/or width, depending on the case, to the secondary faces of the blocks. Each one of the four main faces of the bar has at least two perforations, wherein on one main first face a first perforation is near a first corner and distant from a second corner and a second perforation which is distant from the first corner, is also found, in proportion to the first perforation and the first corner, distant from the second corner. On a second main face of the bar, contiguous to the first main face of the bar, a first perforation is distant from a first corner and near a second corner, and a second perforation is near the first corner according to the previously mentioned proportions. It is required that the perforation pattern be repeated on the four main faces of the bar, in such a way that the first main face of the bar have the same perforation distribution as the face opposite to said main first face of the bar, and that the second main face of the bar, contiguous to the first main face, have the same perforation distribution as the face opposite to said main second face of the bar. When one of the main faces of the bar is in contact with one of the secondary faces of the block, the perforations of the main face of the bar in contact with the secondary face of the block, are aligned with the perforations of the secondary face of the block in contact with the main face of the bar.

The bars are joined to each one of the contiguous blocks by joining means, which are preferably cylindrical pieces. At least one first set of the cylindrical pieces has a fastening means, such as could be an inner screwing on said first set of cylindrical pieces. A second set of cylindrical pieces are substantially longer than the first set of cylindrical pieces. A fastening means external to the bars, cells and cylindrical pieces, is capable of fastening the fastening means of the first set of cylindrical pieces and force the separation between the cylindrical piece and the bar or cylindrical piece and the block. If dealing with a final connection, that is a connection between a bar and an end block, the first set of cylindrical pieces is used, in such a way that the cylindrical piece does not protrude according to the respective perforation of the block and the bar. If dealing with connections between intermediate blocks, the second set of cylindrical pieces is used, in such a way that the cylindrical piece protrudes according to the respective perforation of the block and the bar, with the end goal that the cylindrical piece can be inserted into a perforation of another block.

BRIEF DESCRIPTION OF THE FIGURES

These and other features, aspects and advantages of the present invention, shall be better understood when the following detailed description is taken into account, referencing the accompanying figures, which are:

FIG. 6 is a view of a main face of a first bar embodiment.

FIG. 7 is a view of a secondary face of the first bar embodiment.

FIG. 8 is a frontal face view of the first bar embodiment.

FIG. 9 is a view of the main face of a second bar embodiment.

FIG. 10 is a view of a secondary face of the second bar embodiment.

FIG. 11 is a view of a frontal face of the second bar embodiment.

FIG. 12*a* is a frontal view of a first fastening means.

FIG. 12*b* is an upper view of the first fastening means.

FIG. 13*a* is a frontal view of a second fastening means.

FIG. 13*b* is an upper view of the second fastening means.

FIG. 14 is a frontal view of an external fastening means.

DETAILED DESCRIPTION OF THE INVENTION

Figure 1:
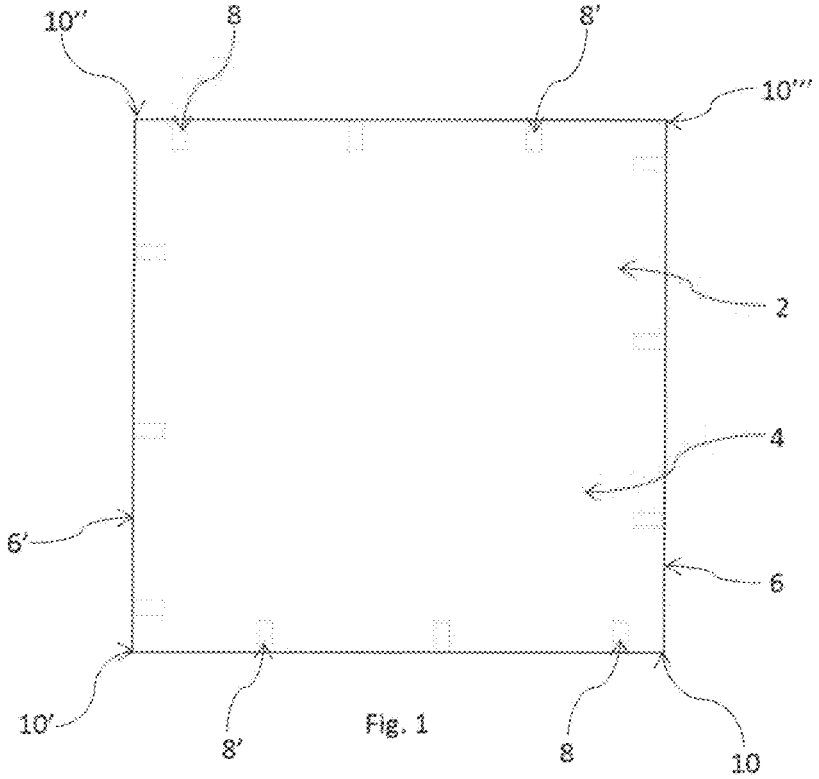
FIG. 1 is a view of a main face of a first block embodiment.
Figure 2:
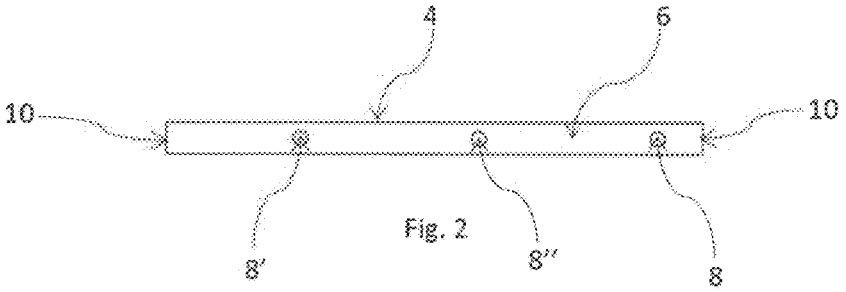
FIG. 2 is a view of a secondary face of the first block embodiment.
Figure 3:
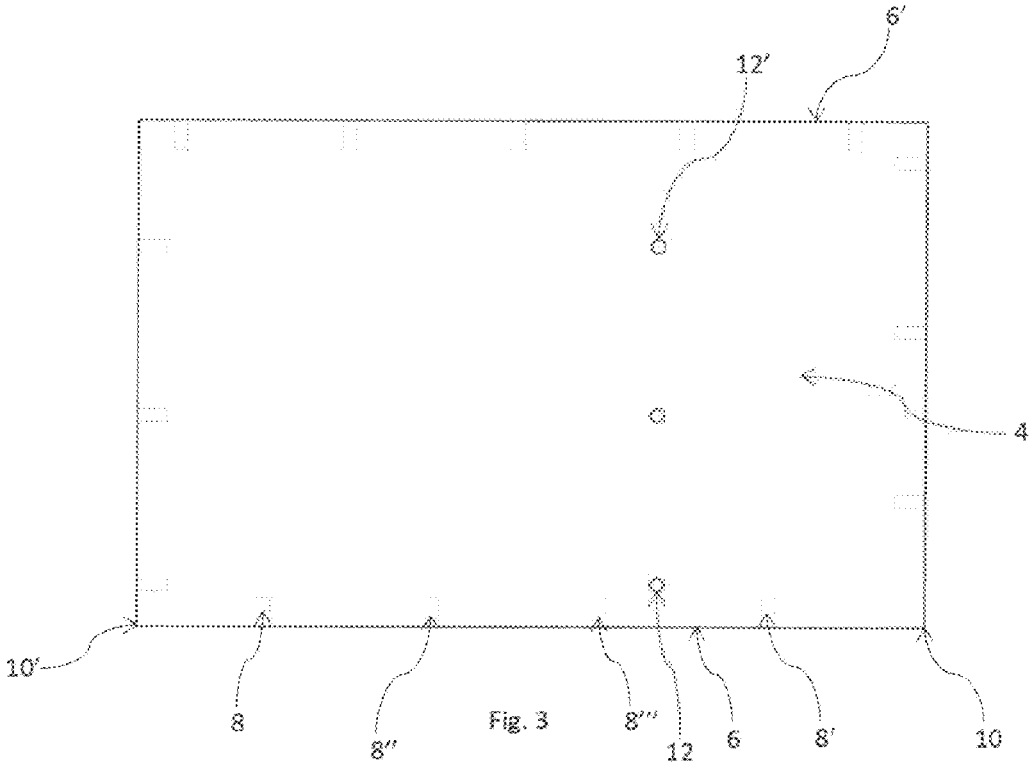
FIG. 3 is a view of a main face of a second block embodiment.
Figure 4:
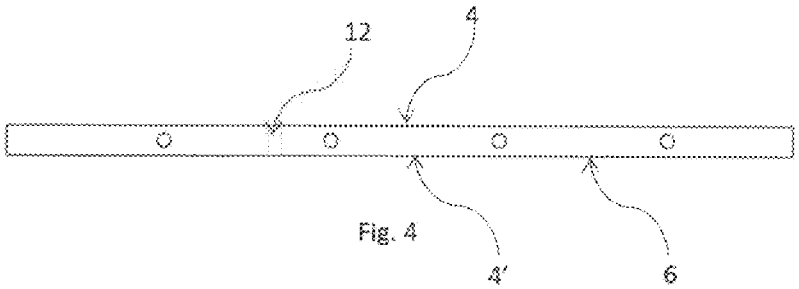
FIG. 4 is a view of a secondary face of the second block embodiment.
Figure 5:
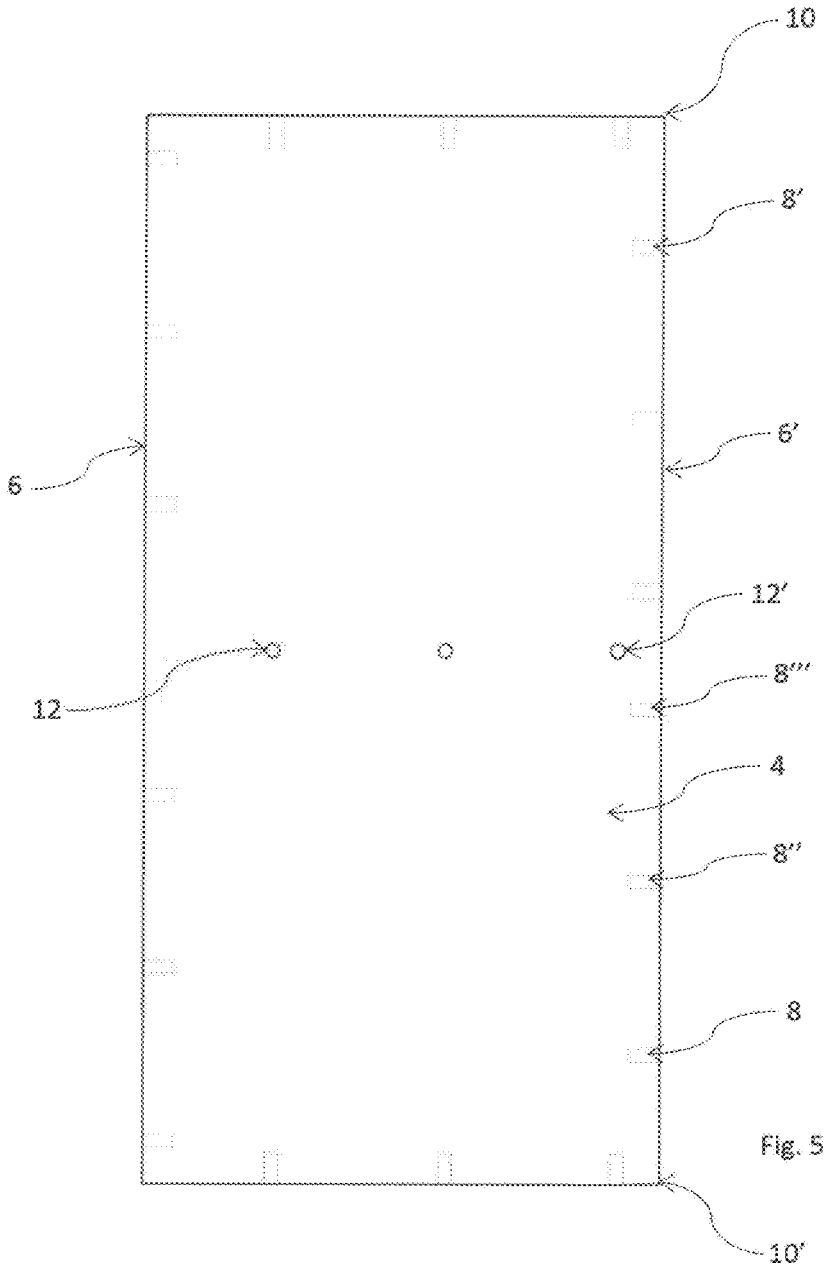
FIG. 5 is a view of a main face of a third block embodiment.
Figure 15:
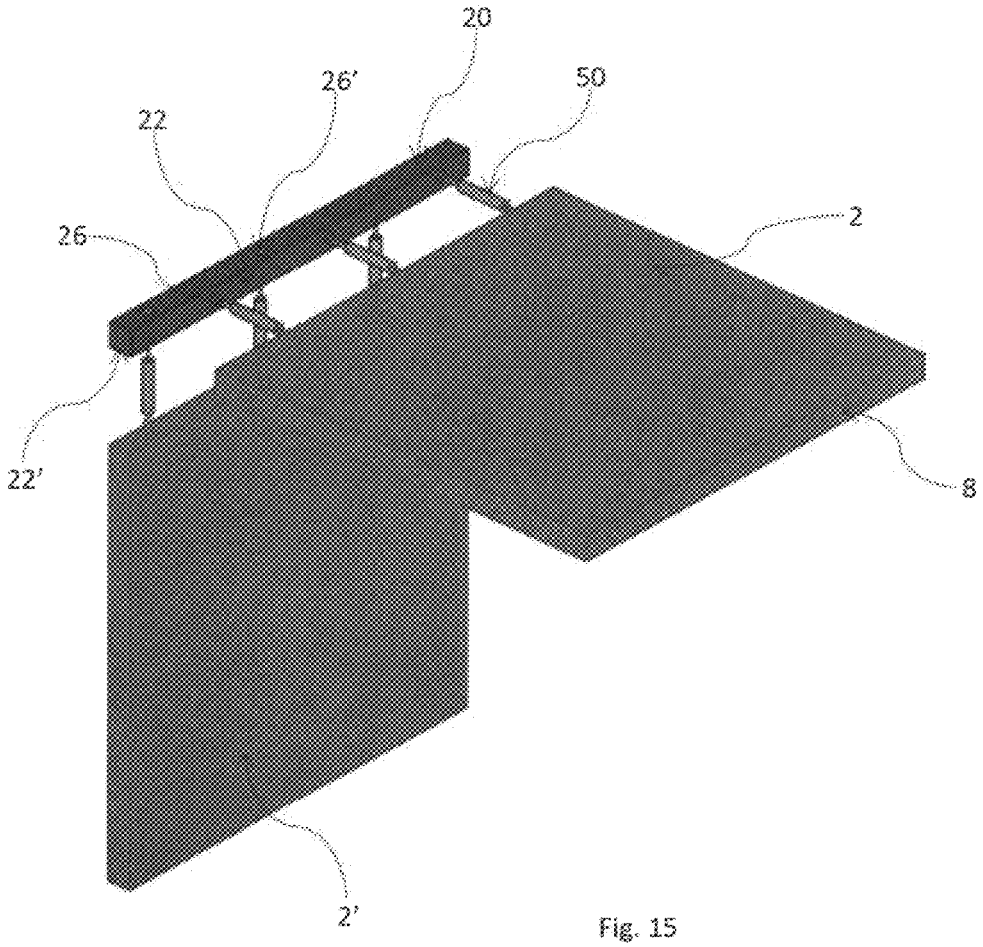
FIG. 15 is an exploded conventional perspective view of two blocks joined to a bar by means of first fastening means.
Figure 16:
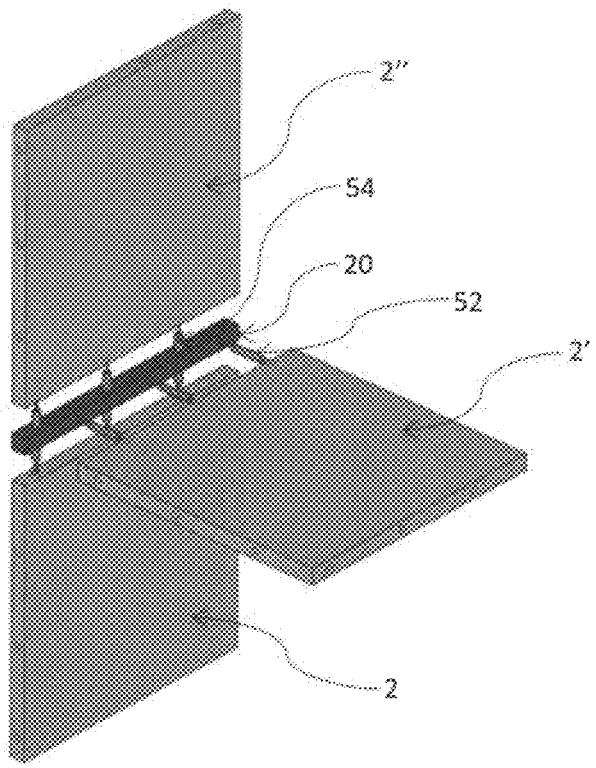
FIG. 16 is an exploded conventional perspective view of three blocks joined to a bar by means of second fastening means.
Figure 17:
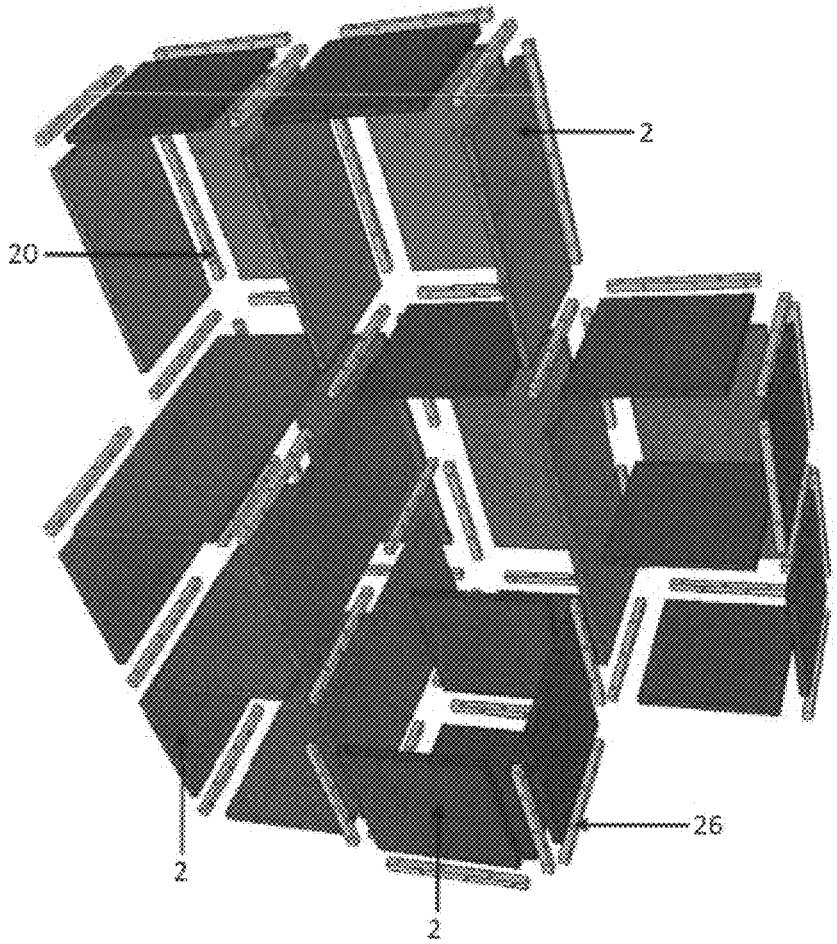
FIG. 17 is an exploded conventional perspective view of a plurality of cells, showing the different blocks used by the present invention.
Figure 18:
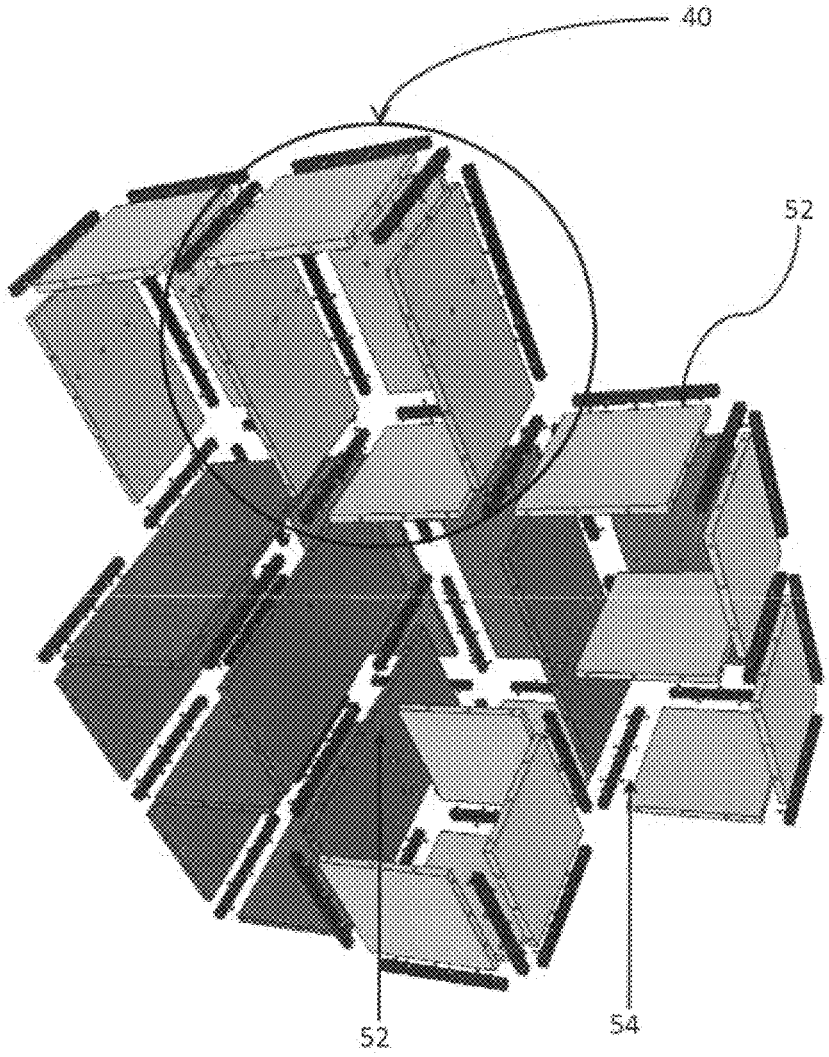
FIG. 18 is an exploded conventional perspective view of a plurality of cells joined to the bars by means of different fastening means.

The following description is made in an indistinctive manner regarding FIGS. 1 through 18.

The present invention refers to modular furniture pieces and more specifically to a modular furniture system. The modular furniture piece system comprises a plurality of unitary blocks 2 joined by means of at least one bar 10. The plurality of blocks 2 conjoined and immediate to one another, joined by an equal number of bars 10 form a cell 20. The material with which the modular furniture piece is formed, and more specifically the unitary blocks 2 and the bars 10 which form the cells 20, can vary, however, it is preferred that stronger materials which do not bend easily, but which also have certain flexibility be used. Such materials are, by way of example yet not limitative, plastics such as polystyrenes, PVC, high density polystyrenes, polypropylenes, PET, etc., wood and agglomerates of the same and derivatives of the same, such as cardboard, corrugated cardboard etc., and metals, such as aluminum, which tend to have certain flexibility.

Each unitary block 2 is preferably, a hexahedron, wherein each hexahedron has preferably flat and smooth faces. It is preferable that said block 2 be a cuboid. The cuboid is formed by two main faces 4, which may be a frontal face and a back face, or an upper face and a lower face, depending on the block orientation 2, wherein the main faces 4 are preferably squared. However, it is possible that the main faces 4 be any other type of quadrilateral, for example rectangular, so that, it is clear that the sides of the main faces 4 can have different lengths. On the other hand, it is preferable that the cuboid have secondary faces 6, such as the four side faces and that said secondary faces 6 be rectangular. However, a cuboid whose side faces 6 are any other type of quadrilateral, for example squares, is possible. Each one of the four secondary faces 6 of the block has at least two perforations 8, and more preferably at least three perforations 8-8", wherein a first perforation 8 is near a first corner 10 of a secondary face 6 and distant from a second corner 10' of the secondary face 6, opposite the first corner 10. A second perforation 8', which is distant from the first corner 10, and is also found, in proportion to the first perforation 8 and the first corner 10, distant from the second corner 10'; however, said second perforation 8' is found closer to the second corner 10' than the first perforation 8. A third perforation 8" can be present depending on the length of the secondary face 6, wherein the third perforation 8" is found at an intermediate point between the first perforation 8 and the second perforation 8'. It is required that the same perforation pattern 8 be repeated on each one of the four secondary faces 6 of the block. In case the main faces 4 are rectangular in shape, and more specifically, that more than three perforations be required 8, the intermediate perforations 8", 8'", will be found equidistant in relation to the end perforations 8, 8' and at an equidistant distance between each other. Thus, in relation to the end perforations 8, 8' of the secondary face 6 of the block, one of the two end perforations 8, 8' is found closer to its respective corner 10, 10' in comparison with the other end perforation 8', 8 which is found more distant from its corner 10', 10. It is preferable that the perforations 8 of the secondary faces 6 be collinear. It should be highlighted that the opposite secondary face 6', despite having the same perforation disposition 8, is found to mirror the secondary face, so that the perforation 8' is found close to the corner 10", while in comparison, the perforation 8' is found distant from the corner 10'".

Over the main faces 4 of the block, a number of perforations 12 can be provided, wherein said perforations 12 have an essentially similar disposition to the perforations 8 of the secondary faces 6. That is, the perforations 12 are also preferred in collinear manner and equidistant to each other. More specifically in case such perforations are present, it would be that a first end perforation 12 is close to a first border where it adjoins the main face 4 with a first secondary face 6, while a second end perforation 12' is found proportionally distant from a second border where it adjoins the main face 4 with a second secondary face 6'. That is, the second perforation 12' in relation to the second border is distant in comparison to the proximity between the first perforation 12 and the first border. The perforations 12 can be found on any part of the main faces, and there can even be more than one group of perforations 12 on the main faces. These perforations 12 on the main faces 4 are plainly optional, and do not depend, or are related to the length of the main face 4. However, it is preferable to provide said perforations 12 on blocks which have the main face 4 in rectangular shape, and specifically where the main face 4 has a length such that where a vertical block 2 can be placed over said main face, and that said main face 4 is not found overly affected in the space provided over said main face 4.

A bar 20 is capable of joining four different blocks 2, wherein the four different blocks 2 joined by said bar 20, generally have an opposite direction. Specifically, the bar 20 joins blocks 2 at 0°, 90°, 180° and 270° to each other. The blocks 2 are coupled unto different points of the bar 20 as shall be described below. In turn, in order to form a cell 40, four bars 20 are needed. Each bar is preferably a hexahedron, wherein said hexahedron preferably has flat and smooth faces. It is preferable that said bar 20 be a cuboid. The bar 20 is formed by four main faces 22 which preferably are rectangular, and more preferably that said main faces 22 of the bar match the shape and the size, specifically the length and the height, to the secondary faces 6 of the block 2. On the other hand, it is preferable that the bar 20 have two secondary faces 24 and that said secondary faces 24 be squares. However, it is possible to have a bar whose secondary faces 24 are any other type of quadrilateral, and where preferably said side faces have a height similar to the height and/or width, depending on the case, of the secondary faces 6 of the blocks 2. Each one of the four main faces 22 of the bar has at least two perforations 26, and more preferably at least three perforations 26-26". Said perforations 26 on the main faces of the bars run from a first main face 22 of the bar to the main face 22 opposite to the first main face; that is, the perforations 26 cross through form a first side of the bar 20 to an opposite side to the first side of the bar 20. A first perforation 26 is near a first corner 28 of a main face 22 and distant from a second corner 28' of the main face 22, opposite to the first corner 28. A second perforation 26', which is distant from the first corner 28, is also found, in proportion to the first perforation 26 and the first corner 28, distant from the second corner 28'; however, said second perforation 28' is found closer to a second corner 28' than the first perforation 26. A third perforation 26" can be present depending on the length of the main face 22, wherein the third perforation 26" is found at an intermediate point between the first perforation 26 and the second perforation 26'. It is clear that upon crossing through the perforations 26 to said bar, from a first side to an opposite side of the bar 20, the opposite side of said bar 20, will have exactly the same perforation disposition 26 than that of said first side of the bar. On a second main face of the bar 20, in near proximity to the first side of the bar, perforations 26 are also found. However, said perforations 26 of the second side of the bar do not coincide axially with the perforations of the first side of the bar 20; specifically the perforations on the first side and the second side are not collinear and consequently on the third side, same which is also in close proximity and in an opposite direction to the first side. Taking the above into account, a first perforation 26 of the second side is distant from a first corner 28 of a main face 22' of the second side, and even further distant from a second corner 28' of the main face 22' of the second side, opposite to the first corner 28. A second perforation 26' is in close proximity to a second corner 28' and distant from the first corner 28. A third perforation 26" may be present depending on the length of the main face 22' of the second side, wherein the third perforation 26" is found at an intermediary point between the first perforation 26 and the second perforation 26'. It is clear that upon crossing through the perforations 26 to said bar 20, from a second side to a third side of said bar 20, wherein said second side and third side of said bar 20 are opposite to each other, the third side of said bar 20 will have exactly the same perforation disposition 26 than that of said second side of the bar 20. Therefore, with this disposition, it is such that the perforations 26 are intercalated on each one of the sides of the bar 20. For example, taking the first corner 28 of the bar 20 as an initial point of reference, the perforation 26 closest to the corner 28 is the perforation 26 of the main face 22 of the first side of the bar 20. The second perforation 26 closest to the corner 28 is the perforation of the main face 22' of the second side of the bar. Following this, the next perforation 26 closest to said corner 28 is the intermediate perforation 26 of the main face 22 of the first side. The following perforation 26 closest to said corner is the intermediate perforation 26 of the main face 22' of the second side. In this manner, the perforations on the different main faces 22-22' are intercalated in such a manner that the perforations of a first side to an opposite side to said first side, do not come into contact with the perforations of a second side to a third side, that is, there is no connection between said perforations on contiguous sides. In the case that said main faces 22 should need to be coupled to a block with a length greater than the one described above with three perforations 26, and more specifically, if more than three perforations 26 are required, the intermediate perforations 26", 26", are found equidistant in relation to the end perforations 26, 26' and at an equidistant distance from each other. Therefore, in relation to the end perforations 26, 26' of the main face 22 of the bar, one of the two end perforations 26, 26' is found closer to its respective corner 28, 28' in comparison to the other end perforation 26', 26 is found more distant from its corner 28', 28. It is preferred that the perforations 26 of the main faces 22 be collinear.

The bars 20 are joined to each one of the contiguous blocks 2 by joining means 50, which preferably are pieces capable of being inserted into the perforations 12, 26 of both the blocks 2 as well as the bars 20, respectively. Given that is possible that the perforations 8, 26 acquire any shape and form, it is also possible that the joining means 50 acquire any shape or form as long as said joining means 50 can be inserted into the perforations 12, 26. It is especially preferred that the perforations 12, 26 adhere to the joining means, in such a way that the joining means 50 once within the perforations 12, 26 be immovable. By way of example, yet by no means limitative, both the perforations 12, 26 as well as the joining means 50 for this particular case have been designed in a cylindrical shape. Said joining means 50 are divided into two different joining means 52, 54. A first type of joining means has a fastening means 56, such as could be an inner screwing on said first type of joining means 52. The fastening means 56 is found on one end of the first type of joining means 52, wherein the orientation of the fastening means 56 is such that it is distant from the center of said joining means 52; that is, the orientation of the fastening means 56 is towards the end in relation to the center of the joining means 52. It is possible that the fastening means 56 be centered in relation to said end of the joining means; however said fastening means 56 may be uncentered. It is preferred that the first joining means 52 have a length which is equivalent to or closely equivalent to the width of the secondary face 24 of the bar 20 and to the width of a secondary face 6 of the block 2. A second type of joining means 54 pieces are substantially longer than the first type of joining means 52. Specifically, it is preferred that the second joining means 54 have a length such that it is equivalent or nearly equivalent to the width of the secondary face 24 of the bar 20 and to the width of two secondary faces 6 of the block 2. The second joining means 54 may or may not have a fastening means 56 similar to the first joining means. A fastening means 58 external to the bars 20, cells 40 and joining means 50, is capable of fastening unto the fastening means 56 of the first type of joining means 52 and move said first joining means 52 according to the perforations 12, 26, in such a way that the separation is forced between the first type of joining means 52 and the bar 20 or the first type of joining means 52 and the block 2. In the specific case exemplified by present application, the fastening means 58 has a head 60 and a body 62, wherein the head 60 allows the fastening means 58 to be supported and the body is a screwed body which may be screwed with the fastening means 56 of the first type of joining means 52. If dealing with a final connection, that is a connection between a bar 20 and an end block 2, the first type of joining means 52 is used, in such a way that the first type of joining means 52 does not protrude in relation to the respective perforation 8 of the block 2 and the perforation 26 of the bar 20. If dealing with connections between intermediate blocks 2, that is, blocks 2 that are not at the end of the furniture piece, the second type of joining means 54 is used, in such a way that the second type of joining means 54 used protrudes in relation to the respective perforation 8 of the block 2 and the perforation 26 of the bar 20, with the end goal that the second type of joining means 54 can be inserted into a perforation 8 of another contiguous block 2.

Thus, the joining means 50 are inserted into the perforations 8 of the blocks 2 to later be inserted into the perforations 26 of the bars 20; it should be highlighted that the order can be reversed, that is, first the perforations of the bar and afterwards the perforations of the blocks. In the case where the joining means 50 has a fastening means 56, the fastening means must be oriented substantially outwardly in relation to the joining block 2, bar 20. Upon aligning the block 2 and the bar 20, it is such that both are the same length, so that one does not protrude in relation to the other in a longitudinal sense. Additionally, upon aligning the block 2 and the bar 20, the perforations 8 of the block are aligned in coaxial manner with the perforations 26 of the bar, in such a way that, as was previously described, the joining means 50 may be inserted into the coaxial perforations, that is, in the perforations 8 of the block and the perforations 26 of the bar. On the other hand, the perforations 26 on the main face 22' of the second side of the bar 20 are free to be able to become aligned with the perforations 8 of a second block 2' which is aligned in a perpendicular fashion to the first block. Upon inserting the joining means 50' into the perforations 8 of the second block 2', the perforations 26 on the main face 22' of the second side of the bar 20 are coaxially aligned with said perforations 8, in such a way that the joining means 50' are inserted into the perforations 26' of the main face 22' of the second side of the bar 20. In this way, the blocks 2 can be aligned in a perpendicular manner, such as was described in the above example, allowing the blocks 2 to have vertical or horizontal directions. If a second block 2' should need to be aligned in the same orientation as the first block 2, a second type of joining means 54 is used which has a greater length than the first type of joining means. The second type of joining means 54 upon being inserted into the perforation 8 of the first block 2 and into the perforation 26 of the bar, said second type of joining means 54 protrudes in relation to said first block 2 and said bar 20, so that a third block 2", which is collinear to the first block 2 van be coupled to said first block 2 and corresponding bar 20 by means of the second type of joining means 54 which is protruding; that is, the part that is protruding on the second type of joining means 54, is inserted into the perforations 8 of the third block 2", thus allowing a collinear connection between the blocks 2.

In this manner, collinear connections can be achieved between different blocks 2, as well as perpendicular connections between different blocks, in this way forming cells 40. A cell is generally composed of four blocks 4 and four bars 20.

Even though the invention has been described in terms of various specific embodiments, those skilled in the art, would recognize that the invention could be carried out with modifications within the reach of present invention as is described in present specification. For example, one skilled in the art would recognize that the joining means 50 do not necessarily need to be cylindrical despite a cylindrical perforation 8, 26. For example, a hexahedral or prismatic joining means capable of being inserted into the perforations 8, 26 would function in the same manner as long as the hexahedral or prismatic joining means come into contact with the borders of the cavity formed by the perforations 8, 26 on both the block 2 as well as the bar 20.

The invention claimed is:

1. A modular furniture system comprising:

at least one block with first and second main faces and a plurality of secondary faces, wherein each of the secondary faces has, at least, a first and second corner located adjacently opposite to one another, and a first perforation and a second perforation, wherein the first perforation of each secondary face is closer to the first corner of the same secondary face than it is to the second corner of the same secondary face, and wherein the second perforation of each secondary face is more distant from the first corner of the same secondary face than it is from the second corner of the same secondary face, and wherein the distance between the first perforation and the first corner of each secondary face is less than the distance between the second perforation and the second corner of the same secondary face;

at least one bar with a first main face and a second main face, perpendicular to each other, and secondary faces, wherein over each one of the first and second main faces of the at least one bar at least a first perforation and a second perforation are found, and wherein the perforations over the main faces of the at least one bar cross through to the opposite face of the main face of the at least one bar, wherein the at least one bar is capable of simultaneously joining four different blocks at 0°, 90°, 180° and 270° to each other; and at least one first joining device and at least one second joining device, wherein the second joining device is substantially longer than the first joining device, wherein the at least one block and the at least one bar are coaxially aligned to form a connection by means of the insertion of either a first joining device or a second joining device through at least one first and at least one second perforations of at least one secondary face of the at least one block and at least one first and at least one second perforations of at least one main face of the at least one bar; and wherein upon joining the at least one block and the at least one bar, the perforations located on at least one secondary face of the at least one block are coaxial to the perforations of the at least one bar connected to said at least one secondary face, and wherein the first joining device has a cylindrical, hexahedral or prismatic shape and has a screwed interior, wherein the screwed interior of the first joining device is oriented against the connection between the block and the bar, wherein the first joining device has a length equivalent or nearly equivalent to the width of the secondary face of the at least one bar plus the width of a secondary face of the at least one block and wherein the system additionally comprises:

an external fastener having a head and a screwed body for screwing with the screwed interior of the first joining device, wherein the external fastener forces a separation between the first joining device and the respective perforations; and wherein the second joining device has a cylindrical, hexahedral or prismatic shape, wherein the second joining device has a length equivalent or nearly equivalent to the width of a secondary face of the at least one bar plus the width of two secondary faces of the at least one block.

2. The system according to claim 1, wherein the at least one block is a cuboid, wherein the main and the secondary faces are substantially flat and smooth, and wherein the secondary faces have an area lesser than the area of the main faces.

3. The system according to claim 1, wherein at least one of the secondary faces of the at least one block has a third intermediate perforation equidistant to the first and second perforation, and wherein at least one of the main faces of the at least one bar has a third intermediate perforation equidistant to the first and second perforations, in such a way that when joining the block and the bar, the third perforation of the at least one block and the third perforation of the at least one bar, are co-axial.

4. The system according to claim 1, wherein at least one of the secondary faces of the at least one block has a third perforation and fourth perforation, wherein the third perforation is closer to a second corner of the at least one secondary face of the at least one block than it is from a first corner of the at least one secondary face of the at least one block, and the fourth perforation is more distant from the second corner of the at least one secondary face of the at least one block than it is from the first corner of the at least one secondary face, and wherein the distance between the third perforation and the second corner is less than the distance between the fourth perforation and the first corner in such a way that said third and fourth perforations mirror the first and second perforations.

5. The system according to claim 1, wherein at least one of the main faces of the at least one block has a plurality of collinear perforations, equidistant from each other and which cross through from said main face to the opposite face of the main face, and wherein the first joining device or second joining device is capable of being inserted through the perforations of the main face of the at least one block.

6. The system according to claim 5, wherein the distance between the at least one first perforation over at least one of the main faces of the at least one block and a first border adjoining said main face of the at least one block and at least one of the secondary faces of the at least one block, is shorter than the distance between a second perforation over said at least one main face of the at least one block and a first border of the at least one main face and is shorter than the distance between the second perforation and a second border opposite to the first border of the at least one main face.

7. The system according to claim 6, wherein at least one of the main faces of the at least one block has a third perforation intermediate and equidistant from the first and the second perforation on said main face of the at least one block, and wherein the first joining device or the second joining device connects a second block with the first, second and third perforations over said main face of the at least one block.

8. The system according to claim 1, wherein the first and second main faces of the at least one bar are substantially perpendicular to each other, so that said bar is capable of simultaneously connecting blocks at 0°, 90°, 180° and/or 270° of said at least one block.

9. The system according to claim 1, wherein said first and second main faces of at least one bar match in shape and size, specifically in length and height, with the secondary faces of at least one block.

10. The system according to claim 1, wherein each of the main faces of the at least one bar has, at least, a first and second corner located adjacently opposite to one another, wherein the first perforation found over the first main face of the at least one bar is closer to the first corner of the same first main face of the at least one bar than it is to the second corner of the same first main face of the at least one bar; and the second perforation found over the first main face of the at least one bar is further from the first corner of the same first main face of the at least one bar than it is from the second corner of the same first main face, and wherein the distance between the first perforation found over the first main face of the at least one bar and the first corner of the same first main face is less than the distance between the second perforation found over the first main face of the at least one bar and the second corner of the same first main face, wherein the second main face of the at least one bar further comprises at least a third and a fourth perforation, wherein the third perforation found over the second main face of the at least one bar is closer to the second corner of the same second main face of the at least one bar than it is to the first corner of the same second main face of the at least one bar; and the fourth perforation found over the second main face of the at least one bar is further from the second corner of the same second main face of the at least one bar than it is to the first corner of the same second main face, and wherein the distance between the third perforation and the second corner is less than the distance between the fourth perforation and the first corner located on the same second main face.

11. The system according to claim 10, wherein the first perforation found over the first main face of the at least one bar is closer to the first corner of the same first main face of the at least one bar than it is to the second corner of the same first main face of the at least one bar; and the second perforation found over the first main face of the at least one bar is closer to the second corner of the same first main face of the at least one bar than it is to the first corner of the same first main face of the at least one bar; and wherein the third perforation found over the second main face of the at least one bar is distant from the first corner of the same second main face and from the center of the same second main face; and the fourth perforation found over the second main face of the at least one bar is distant from the second corner of the same second main face and from the center of the same second main face.

12. The system according to claim 11, wherein the perforations on the different main faces of the at least one bar are intercalated in such a way that the perforations of the first main face of the at least one bar are not in connection with the perforations of the second main face of the at least one bar.

13. A modular furniture system comprising: at least one block with first and second main faces and a plurality of secondary faces, wherein the plurality of secondary faces have, at least, a first and second corner located adjacently opposite to one another, a first perforation and a second perforation, wherein the first perforation of each secondary face is closer to a first corner of its respective secondary face than it is to a second corner of the secondary face of the at least one block, and wherein the second perforation is more distant from the first corner of the secondary face of the at least one block than it is from the second corner of the secondary face, and wherein the distance between the first perforation and the first corner is less than the distance between the second perforation and the second corner;

at least one bar with a first and a second main faces, perpendicular to each other, and secondary faces, wherein over each one of the main faces of the at least one bar at least a first perforation and a second perforation are found, and wherein the perforations over the first and second main faces of the at least one bar cross through to the opposite face of the at least one bar, wherein the at least one bar is capable of simultaneously joining four different blocks at 0°, 90°, 180° and 270° to each other; and a first joining device inserted into a perforation of the at least one block and of the at least one bar to connect the at least one block and the at least one bar, wherein the at least one block is aligned with the at least one bar; and wherein upon joining the block and the bar, the perforations of the at least one block are coaxial to the perforations of the at least one bar, and wherein the first joining device has a cylindrical, hexahedral or prismatic shape and a screwed interior, wherein the screwed interior of the first joining device is oriented against the connection between the block and the bar, and wherein the system additionally comprises:

an external fastener having a head and a screwed body for screwing with the screwed interior of the first joining device, wherein the external fastener forces a separation between the first joining device and the respective perforations of the at least one block and of the at least one bar, wherein at least one of the main faces of at least one block has a plurality of collinear perforations, equidistant to each other and which cross from said main face to the opposite face of said main face, wherein a first perforation of the plurality of collinear perforations over said at least one main face of the at least one block is closer to a first border of the at least one block to a second border of the at least one main face, wherein the first border and the second border are opposite relative to one another and parallel, and wherein the first joining device can be inserted through a perforation of the plurality of collinear perforations of the at least one main face of the at least one block.

14. The system according to claim 13, wherein said first and second main faces of at least one bar match in shape and size, specifically in length and height, with the secondary faces of at least one block, wherein the second main face of the at least one bar further comprises at least a third and fourth perforations; and wherein the perforations on the first and second main faces of the at least one bar are intercalated in such a way that the perforations of the first main face of the at least one bar are not in connection with the perforations of the second main face of the at least one bar.

15. A modular furniture piece comprising:

at least four blocks with first and second main faces and a plurality of secondary faces which each of the secondary faces have, at least, a first and second corner located adjacently opposite to one another, a first perforation and a second perforation, wherein the first perforation over a secondary face is closer to a first corner of the same secondary face in comparison to the second perforation to a second corner of the same secondary face, at least four bars with a first main face and a second main face, perpendicular to each other, and secondary faces, wherein over each one of the first and second main faces of the at least four bars at least a first and a second perforations are found, and wherein the at least first and second perforations over the first and second main faces of the at least four bars cross through to the opposite face of the first and second main faces of the at least four bars, wherein the at least one bar is capable of simultaneously joining four different blocks at 0°, 90°, 180° and 270° to each other; and a first joining device inserted into each perforation of the at least four blocks and the at least four bars;

wherein the at least four blocks are in connection by means of the bars and the first joining device inserted within the perforations of the blocks and the bars, wherein the blocks are aligned with the bars such that the perforations located on at least one secondary face of the blocks are aligned in coaxial manner with the perforations of the at least one bar connected to said at least one secondary face, wherein said at least four blocks form a cell, and wherein the first joining device has a cylindrical, hexahedral or prismatic shape and a screwed interior, wherein the screwed interior of the first joining device is oriented against the connection between the block and the bar, and wherein the system additionally comprises: an external fastener having a head and a screwed body for screwing with the screwed interior of the first joining device, wherein the external fastener forces a separation between the first joining device and the respective perforations.

16. The furniture piece according to claim 15, wherein at least one of the main faces of a block of the at least four blocks has a plurality of collinear perforations, equidistant from each other and which cross through from said main face to the opposite face of the main face, wherein a first perforation over said main face of the block of the at least four blocks is closer in proximity to a first border of the main face in comparison to the second perforation over the main face of the block of the at least four blocks to a second border of the main face, wherein the first and second borders are opposite relative to one another and parallel, and wherein the first joining device can be inserted through said perforation of the main face of the block of the at least four blocks.

17. The furniture piece according to claim 15, wherein said first and second main faces of the at least one bar match in shape and size, specifically in length and height, with the secondary faces of the at least one block.

18. The furniture piece according to claim 15, wherein the second main face of the at least one bar further have at least a third and fourth perforation.

19. The furniture piece according to claim 18, wherein the perforations on the first and second main faces of a block of the at least four bars are intercalated in such a way that the perforations of the first main face of the block of the at least four bars are not in connection with the perforations of the second main face of the bar of the at least four bars.

* * * * *